US005314033A

United States Patent [19]

Tibbitts

[11] Patent Number: 5,314,033

[45] Date of Patent: May 24, 1994

[54] DRILL BIT HAVING COMBINED POSITIVE AND NEGATIVE OR NEUTRAL RAKE CUTTERS

[75] Inventor: Gordon A. Tibbitts, Salt Lake City, Utah

[73] Assignee: Baker Hughes Incorporated, Houston, Tex.

[21] Appl. No.: 837,035

[22] Filed: Feb. 18, 1992

[51] Int. Cl.[5] ..... E21B 10/46

[52] U.S. Cl. ..... 175/431; 175/430; 175/434; 175/432

[58] Field of Search ..... 175/434, 435, 426, 431, 175/432, 428, 425

[56] References Cited

U.S. PATENT DOCUMENTS 4,554,986 11/1985 Jones ..... 175/397
4,932,484 6/1990 Warren et al. ..... 175/385 X
4,981,184 1/1991 Knowlton et al. ..... 175/397 X
5,028,177 7/1991 Meskin et al. ..... 408/145
5,119,892 6/1992 Clegg et al. ..... 175/431

*Primary Examiner*—Stephen J. Novosad
*Attorney, Agent, or Firm*—Trask, Britt & Rossa

[57] ABSTRACT

A drill bit, and a cutter for a drill bit, are provided, wherein the cutter will encounter the formation with cutting surfaces of differing rake angles to optimize cutting efficiency. In most circumstances, the cooperating cutters will have differing, positive, and negative or neutral rakes. Cutters of differing rakes may be cooperatively paired on a drill bit such that the portion of a formation which is affected by the action of one cutter may be similarly affected by the operation of the other cutter.

20 Claims, 4 Drawing Sheets

DRILL BIT HAVING COMBINED POSITIVE AND NEGATIVE OR NEUTRAL RAKE CUTTERS

BACKGROUND OF THE INVENTION

1. Field of the Invention

This invention relates generally to drill bits and drill bit cutter arrangement primarily for use in plastic formations, and more particularly relates to a bit that includes cooperative combinations of positive and neutral or negative rake cutters.

2. State of the Art

Conventional rotary drill bits typically employ hardened cutters formed of materials such as polycrystalline diamond compacts (PDC's), boron nitride, or tungsten carbide and disposed on the bit face in order to produce shearing forces in the formation to be cut. Ordinarily, these cutters are angularly positioned on the face of the drill bit according to the formation material that they are designed to cut.

For example, positive rake or "front raked" cutters have an angle of inclination in the direction of bit rotation of greater than 90°. In other words, positive rake cutters lean forward, or in the direction of bit rotation, and the included angle between the cutter face and the formation in front of it is greater than 90°. These positive rake cutters tend to "dig in" to the formation material, as they do not put additional compressional stresses into the formation, which would give it a higher effective strength. The rotation and weight on the drill bit encourages these positive rake cutters to cut into the formation to their fully exposed depth, which could risk stalling of the bit. However, the hardness of the formation material may resist full depth penetration by the positive rake cutter. Thus, in relatively hard material the positive rake cutters will typically not invade the formation material to their full depth, although the possibility of stalling the drill bit may still be a consideration.

On the other hand, a drill bit having positive rake cutters that is used in a formation having a greater plasticity will likely result in full depth entry of the positive cutters and will correspondingly result in high torque which may stall the bit. Accordingly, drill bits designed primarily for use in formations of greater plasticity typically employ cutters having a negative rake.

The face of a negative rake or "back raked" cutter has an angle of inclination or included angle relative to the formation, that is less than 90°, or opposite to that of a positive rake cutter. In use, the negative rake cutter has a tendency to "ride" along the surface of the formation giving it a higher effective strength and more "plasticity," resisting entry into the formation and making only a shallow cut as a result of the weight on the bit. It can be seen that while negative rake cutters advantageously resist stalling of the bit in plastic formations because of lower aggressiveness, the linear rate of cut for a bit having negative rake cutters is typically substantially less than the linear rate of cut for a bit having positive rake cutters.

It is known in the art from U.S. Pat. No. 4,554,986 to utilize positive rake cutters disposed on a radially-oriented ridge on a bit face, trailing and separated from a leading radially-oriented ridge, the former being devoid of cutters but having wear elements embedded therein. The leading ridge limits the depth of penetration of the positive rake cutters on the trailing edge.

It is also known in the art from U.S. Pat. No. 4,981,184 to utilize ridge-mounted positive rake cutters disposed on a bit face in trailing relationship to ridge-mounted, dome-shaped "cutter inserts" which purportedly deform and stress the formation being drilled to its elastic limit, following which the positive rake cutters clip off the deformed formation. Each positive rake cutter is preceded by a dome-shaped cutter insert.

The cutter penetration limitation approach as described in the '986 patent does not take advantage of the cutting characteristics of positive rake cutters. The '184 patent, on the other hand, seeks to employ a "twin blade" approach similar to that utilized with facial razors, and is admirable in theory. However, variations in formation characteristics, pressures, drilling fluid weights and compositions during actual drilling all serve to preclude the realization of an actual drill bit performing in the manner described.

SUMMARY OF THE INVENTION

In contrast to the prior art, the present invention provides a new drill bit which utilizes combinations of positive and neutral or negative rake cutters, the differing cutter types being cooperatively arranged to improve formation cutting and to avoid "digging in" and stalling of the bit under a variety of diverse real world drilling conditions.

In one exemplary embodiment of the present invention a drill bit is adapted for rotatably cutting a borehole. The drill bit includes a bit body having an exterior face adapted for substantial contact with the formation at the bottom of the borehole. In one exemplary embodiment of the invention, a first plurality of cutters is distributed across the face of the bit. Each of these cutters follows a preselected helical path into the formation during the cutting of the formation borehole. Each of the cutters has a cutting surface formed thereon and angularly positioned relative to the preselected helical cutting path at an angle of greater than 90°, i.e., effective, "positive rake." In this exemplary embodiment, a second plurality of cutters is also distributed across the face of the bit. Each of the cutters of this second plurality of cutters, again, follows a preselected helical path into the formation during the cutting of the formation borehole. Each of the second plurality of cutters has a cutting surface formed thereon and angularly positioned relative to the preselected helical path at an angle of 90° or less, i.e., an effective "neutral rake" or "negative rake." In a particularly preferred embodiment, each of the first plurality of cutters is cooperatively associated with at least one of the second plurality of cutters. This may serve both to limit the cutting depth of the first plurality of cutters, and to enhance the cooperative cutting by both sets of cutters. It is contemplated that a positive rake cutter may lead or follow its cooperating neutral or negative rake cutter in the direction of bit rotation, or be radially adjacent thereto.

In a further exemplary embodiment of the invention, the bit will include cutters which have first and second cutting surfaces formed thereon which are disposed at differing cooperating rakes. For example, the first cutting surface may be angularly positioned relative to the preselected helical cutting path at a positive rake and the second cutting surface may be angularly positioned relative to the preselected helical cutting path at a neutral or negative rake. Additionally, one of these cutting surfaces, such as the negatively raked surface, may be disposed at an angle, commonly termed the degree of "side rake," relative to the face of the other cutting surface; or one or both surfaces may be positioned at a side rake angle relative to a radius of the bit.

Additionally, bits in accordance with the present invention may include cutting surfaces having differing degrees of a similar rake (i.e., for example, differing degrees of positive rake) and may be cooperatively paired to function as a unit. For example, such cutting surfaces may be placed in such proximity and in such relation (such as side rake of one or more cutting surfaces) that the portion of a formation affected by one cutting surface encounters the other cooperating cutting surface.

BRIEF DESCRIPTION OF THE DRAWINGS

in FIG. 7B, from a side view; and in FIG. 7C, from a rear view.

FIG. 10A depicts a cutter from a bottom plan view (looking upwardly), and FIG. 10B depicts this same cutter from a side view.

DETAILED DESCRIPTION OF PREFERRED EMBODIMENT

Figure 1:
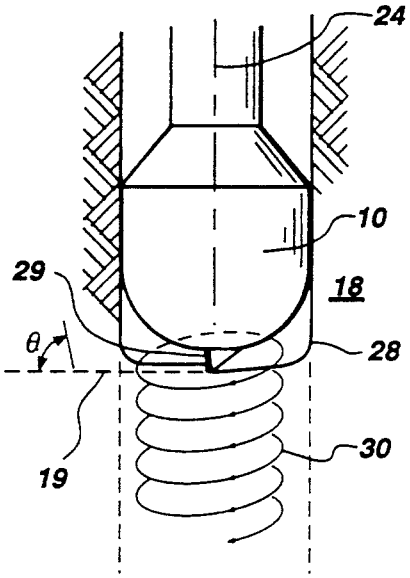
FIG. 1 is a schematic side elevation of a drill bit with the helical cutting path of a selected cutter schematically depicted in relation thereto.

Referring to FIG. 1 of the drawings, it should be noted that, while the angle of inclination of a cutting surface relative to the formation 18 is determinative of whether a particular cutter is classified as positive or negative rake cutters, the contact between the formation 18 and a cutter does not occur on a horizontal path. Rather, since a drill bit is rotating and moving downward into the formation as the borehole is cut, the cutting path followed by an individual cutter on the surface of the bit follows a helical path, as conceptually shown with respect to bit 10 depicted in FIG. 1. Bit 10 is illustrated having a longitudinal axis or centerline 24 that coincides with and extends into the longitudinal axis of a borehole 26. For illustrative purposes, bit 10 is shown having a single cutter 28 affixed on the exterior surface of the drill bit 10. It should be understood that a bit typically employs numerous cutters, but for the purposes of illustrating the helical path followed by an individual cutter on bit 10, as well as the effective rake angle of an individual cutter, only a single cutter 28 has been illustrated. The helical cutting path traveled by the cutter 28 is illustrated by solid line 30 extending the borehole 26 into formation 18.

The lone cutter 28 may have what would appear to be a negative rake angle relative to the horizontal surface 19' of the formation 18. The angle 8 formed between the horizontal and the planar cutting surface 29 of the cutter 28 is less than 90°. However, since bit 10 produces a downward linear motion as it drills the borehole 26, the effective path followed by the cutter 28 is generally downward at an angle of inclination related to the drilling rate of bit 10.

For example, a bit 10 having a cutter 28 rotating in a radius of six inches, at a drilling rate of ten feet per minute, and a rotational speed of 50 revolutions per minute results in the helical path 30 having an angle of inclination relative to horizontal of approximately 4°. Accordingly, if the cutting surface 29 of cutter 28 has an apparent angle of inclination relative to horizontal of approximately 86° (4° negative rake, relative to horizontal), then the cutting surface 29 has an effective angle of inclination, or effective rake, of precisely 90° and will be neither negatively nor positively raked. Such a rake angle may be termed a "neutral" rake or rake angle.

It should be recognized that the radial position of the cutter 28 is determinative as to the effective rake angle. For example, if the cutter 28 is positioned on the surface of the drill bit 10 at a radial distance of only three inches from the center, then its path has an angle of inclination relative to the horizontal of approximately 7°. The closer a cutter is positioned to the bit center, the greater the angle of inclination relative to the horizontal for a given rotational speed and given actual rake, and the greater the apparent negative rake of the cutter must be to obtain an effective negative rake angle.

In order to properly locate and orient cutter 28 and cutting surface 29 to have an effective positive, neutral or negative rake, it is desirable to estimate performance characteristics of the drill bit 10, as well as to determine the radial position of the cutter 28. For example, assuming that the cutter 28 is radially located six inches from the bit centerline and cutting surface 29 is inclined at an angle of 88° (2° negative rake relative to horizontal) and the drill bit 10 is being designed to achieve the drilling rate and rotational speed characteristics discussed immediately above, such that the helical path is inclined at an angle of 4°, then the effective rake angle of the cutting surface 29 is 92° (88°+4°=92°=2° positive rake). Thus, while the apparent angle of inclination or rake angle of the cutting surface 29 appears to be negative, the effective rake angle is actually positive. Such a design methodology would, of course, be performed for each cutter on a drill bit. It should be noted that not all boreholes have a vertical longitudinal axis. Therefore, it is appropriate to refer to the apparent angle of inclination as the angle formed between the planar cutting surface and a plane perpendicular to the longitudinal axis 24 of the bit. The "effective rake angle," on the other hand, refers to the effective angle of inclination when the rotational speed and rate of penetration of bit 10 are taken into account. Accordingly, with the "effective rake angle" the angles of inclination of the cutting surface of drill bit cutters described hereinafter are measured and characterized as positive, negative or neutral relative to the intended helical cutting path 30 and not relative to horizontal (unless otherwise noted).

Figure 2:
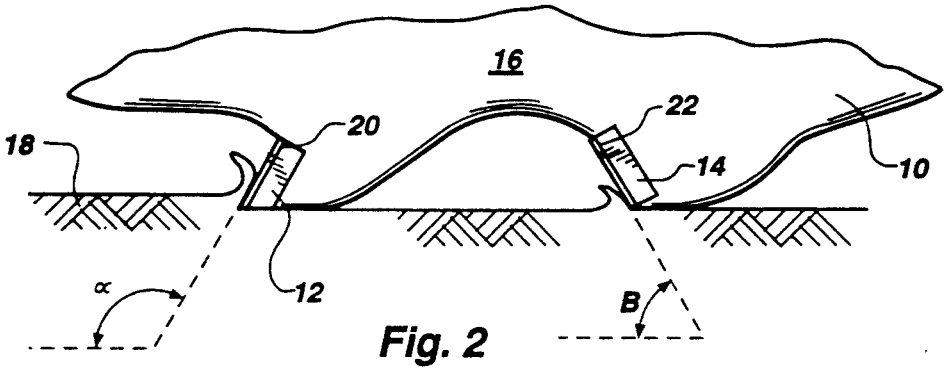
FIG. 2 is a side elevation of a pair of positive and negative rake cutters positioned on a bit body surface.

Referring now particularly to FIG. 2, therein is depicted a side elevation of a portion of a drill bit 10 with a positive rake cutter 12 and a negative rake cutter 14 affixed thereto. As noted above with respect to FIG. 1, the terms "positive" and "negative" rake are employed with reference to the effective angle between the cutting surface and the formation. The cutters 12 and 14 are secured in the bit body 16 in a conventional manner, such as by being furnaced therewith in the body of a metal matrix type bit, attached to a bit body via studs, or brazed or otherwise attached to the bit body 16. It should be understood that the present invention is applicable to any type of drill bit body, including matrix, steel and combinations thereof, the latter including without limitation the use of a solid metal (such as steel) core with matrix blades, or a matrix core with hard-faced, solid metal blades. Stated another way, the present invention is not limited to any particular type of bit design or materials. In FIG. 1, the positive rake cutter 12 and the negative rake cutter 14 are illustrated removing formation material 18 in response to movement of the bit body 16 (and therefore cutters 12, 14), in a direction as indicated by arrow 19. The formation material 18 is in a plastic stress state and may be thought of as a flowing type material.

Cutters 12, 14 each preferably includes a generally planar cutting surface 20, 22. These cutting surfaces 20, 22 can be any of a variety of shapes known in the art. For the illustrated example, they may be considered as being of a conventional circular or disc shape. Cutting surfaces 20, 22 are preferably formed of a hard material, such as diamond or tungsten carbide, to resist wearing of the cutting surfaces caused by severe contact with the formation 18. In a particularly preferred embodiment, these cutting faces will each be formed of a diamond table, such as a single synthetic polycrystalline diamond PDC layer (including thermally stable PDC), a mosaic surface composed of a group of PDC's, or even a diamond film deposited by chemical vapor deposition techniques known in the art.

The angle of inclination of the cutting surfaces 20, 22 relative to the formation 18 is defined as positive or negative according to whether the angle formed therebetween is greater than or less than 90°, respectively, relative to the direction of cutter travel. For example, the cutting surface 20 of positive rake cutter 12 is illustrated having an angle of inclination or included angle $\alpha$ relative to the formation of greater than 90°. That is to say, the bit face end or edge of planar cutting surface 20 leans away from the formation 18 with the leading edge of the cutting surface 20 contacting the formation 18. This positive rake of the cutting surface 20 encourages the cutter 12 to "dig in" to the formation 18 until the bit body 16 contacts the formation 18.

In contra-distinction thereto, the negative rake angle of cutting surface 22 of cutter 14 has an angle of inclination or included angle $\beta$ relative to the formation that is less than 90° relative to the formation 18. The lower circumferential cutting edge of the cutting surface 22 engaging formation 18 trails the remaining portion of the cutting surface 22, such that the cutter 14 has a tendency to ride along the surface of the formation 18, making only a shallow cut therein. The cutting action caused by the cutter 14 is induced primarily by the weight on bit 10. Cutting surface 22 may also be oriented substantially perpendicularly to formation 18, thus being at a "neutral" rake, or at 0° backrake. In such an instance, cutting surface 22 will engage the formation 18 in a cutting capacity but will also ride on the formation as is the case negative rake cutters. It is believed that enhanced side rake of such a cutter will increase its cutting action by promoting clearance of formation cuttings from the cutter face.

The combined use of positive and negative or neutral rake cutters has a balancing effect that results in the positive rake cutter producing a shallower cut than it would otherwise do absent the negative or neutral rake cutter 14. Similarly, the negative or neutral rake cutter 14 produces a deeper cut than it would otherwise do absent the positive rake cutter 12. For example, while the positive rake cutter 12 encourages the drill bit 10 to be pulled into the formation 18, the negative or neutral rake cutter 14 urges the drill bit 10 to ride along the surface. Therefore, the combined effect of the positive and negative or neutral rake cutters 12, 14 is to allow a bit 10 to produce cuts at a depth somewhere between the full and minimal depth cuts which could be otherwise urged by the positive and negative rake cutters individually. It should be noted that the rake of positive rake cutter 12 may be more radical or significant in the present invention than might be expected or even possible without the cooperative arrangement of cutters 12 and 14, in order to aggressively initiate the cut into formation 18, rather than "riding" or "skating" thereon, and to cut without stalling, even in softer formations.

Figure 3A:
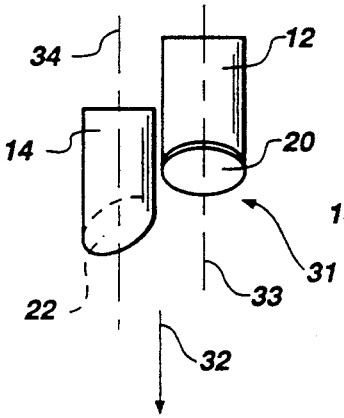
FIGS. 3A–B are top plan views of pairs of positive and negative rake cutters cooperatively positioned to cut plastic formation material. The pair in FIG. 3A are arranged on parallel axes, while the pair in FIG. 3B are arranged on converging axes (with one cutter having a side rake relative to the direction of travel.)
Figure 3B:
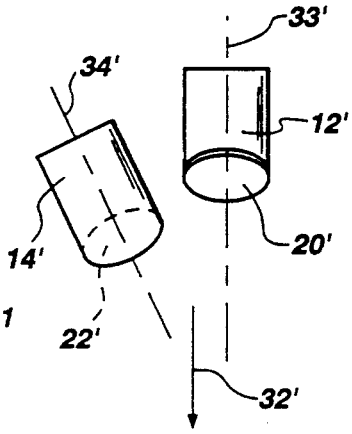

FIGS. 3A–B illustrates a top view (looking through the drill bit at the formation) of two pairs of positive and negative rake cutters 12, 14 cooperatively positioned to cut plastic formation material. Referring first to FIG. 3A, the pair of cutters 31 is depicted having a direction of travel as indicated by the arrow 32, such that the longitudinal axes 33, 34 of the cutters 12, 14 are generally parallel therewith. The cutter 12 includes its generally circular cutting surface 20 arranged at a positive rake. The plane of the cutting surface 20 is generally perpendicular with the direction of travel, indicated by arrow 32. More precisely, a tangent line at the top or bottom portion of the circular cutting surface 20 lies within the cutting plane 20 and is perpendicular to the longitudinal axis 33.

The negative rake cutter 14 is adjacent the positive rake cutter 12 with its cutting surface 22 defining a plane which is angularly disposed relative to the axis 34 of cutter 14, and to the direction of rotation 32; i.e., the cutting face is "side raked." In the depicted pair 31, the trailing edge of cutting face 22 is adjacent cutting face 20; thereby leading toward cutter 12. Preferably, at least a portion of the intersection of the cutting planes 20 and 22 occurs along the cutting surface 20. In this manner, plastic formation material 18 first engages the lower cutting surface of negative rake cutter 14 and is moved in a direction generally toward positive rake cutter 12. Thereafter, the cutting surface 20 of cutter 12 shearingly removes the formation material 18 that the cutter 14 has directed to it. Thus, the cutters 12, 14 cooperatively interact with one another to remove formation material.

In FIG. 3B, second pair 31' of cutters 12' and 14' differs from pair 31 in that negative rake cutter 14' is arranged such that cutting face 22' of negative rake cutter 14 is still at a side rake relative to the direction of rotation, but is perpendicular to the body of cutter 14' (rather than at an angle as with cutter 14 of pair 31).

Figure 4A:
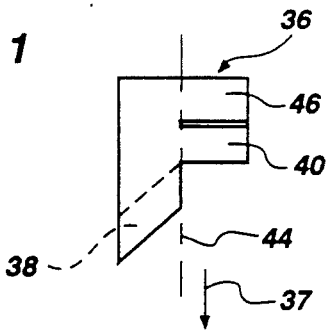
FIGS. 4A–B depict an embodiment of a combination cutter having both positive and negative rake cutting surfaces, depicted in FIG. 4A from a top plan view; and depicted in FIG. 4B from a side view.

FIGS. 4A and B illustrate an embodiment of a combination cutter 36 having both positive and negative rake cutting surfaces 38, 40 disposed thereon. The direction of travel of the combination cutter 36 is generally indicated by arrow 37. Combination cutter 36 is of a generally cubic configuration with the cutting surfaces 38, 40 formed thereon. Combination cutter 36 can be divided into two functional halves along a longitudinal centerline 44 parallel to the direction of travel. The first half of the cutter 36 includes the negative rake cutting surface 38 slanted toward the positive rake cutting surface 40, similar to the negative rake cutter 14 and cutting surface 22 of FIG. 3 relative to positive rake cutter 12 of that figure.

The second portion of the cutter 36 includes the positive rake cutting surface 40 inclined toward the formation material 18 with the lower cutting edge being generally perpendicular to the direction of travel. The lower cutting edges of the cutting surfaces 38, 40 are generally adjacent one another and, preferably, they are immediately adjacent one another at their intersection with the longitudinal centerline 44 along a bottom surface 46 of the cutter 36.

The negative rake cutting surface 38 is shown leading the positive rake cutting surface 40 in the direction of travel. Like the pairs of cutters 31 and 31' in FIG. 3, the cutting surfaces 38, 40 of combination cutter 36 are defined by planes that intersect, at least partially, along the cutting surface 40. In this manner, the negative rake cutting surface 38 displaces a portion of the plastic formation material 18 and urges the displaced formation material 18 in a direction generally toward the positive rake cutting surface 40.

Combination cutter 36 may be secured to a bit body in a conventional manner, such as, being formed in the metal matrix of the bit body, or by attachment thereto such as by studs integrally furnaced within the matrix of the bit body-steel body 16, or by other mechanical arrangements. Cutting surfaces 38, 40 can be any of a variety of shapes known in the art, but preferably are of a conventional rectangular cross section. Further, the cutting surfaces 38, 40 are preferably formed of diamond as described relative to cutters 12 and 14 of FIG. 1.

Figure 5:
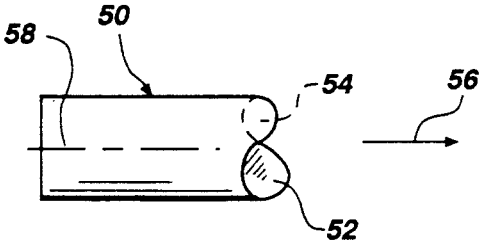
FIG. 5 is a top view of another embodiment of a combination cutter having both positive and negative rake cutter portions.

Referring now to FIG. 5, a generally cylindrical cutter 50 having positive and negative cutting surfaces 52, 54 is illustrated from the perspective of one looking through the bit face into the formation. In this embodiment the cutting surfaces 52, 54 are not defined by a planar surface but rather are arcuately shaped, such as may be defined by a cylinder intersecting the cylindrical cutter 50 at a right angle or other angle relative to the direction of travel and at an angle relation to a horizontal line through cutter 50. Cutter 50 may be placed in the bit crown at any angle skewed with respect to an axis perpendicular to the bit profile, for example, such that the positive rake cutting surface 52 leads the negative rake cutting surface 54. The result of this is that when cutter 50 is moving in the direction of travel indicated by the arrow 56, the positive cutting surface 52 is separating a layer of formation material 18 and directing it generally toward the negatively raked cutting surface 54. It should be noted that cutter 50 may also be rotated about its longitudinal axis 58 as desired for appropriate orientation of cutter 50 with respect to the bit face. Once against, the cutting surfaces 52, 54 preferably are formed of a hardened material, such as diamond or tungsten carbide.

Figure 4B:
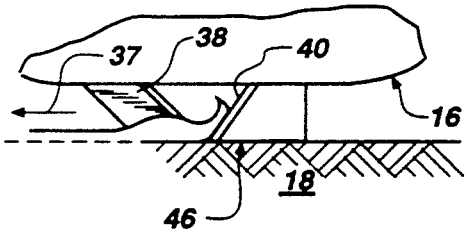
Figure 6:
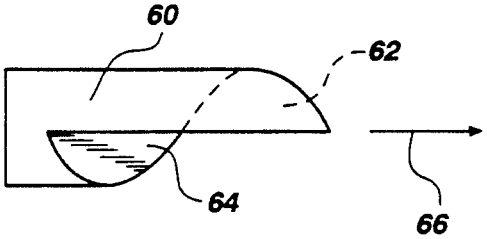
FIG. 6 a top view of another embodiment of a combination cutter having both positive and negative rake cutter portions.

Referring now to FIG. 6, therein is depicted another embodiment 60 of a combination cutter. Combination cutter 60 is substantially similar to the embodiment illustrated in FIG. 4, with the exception that the cutter 60 is formed from a cylindrical body, rather than a cubic body. Thus, combination cutter 60 has a pair of cutting surfaces that are generally half ovoid in cross section. The negative rake cutting surface 62 preferably leads the positive rake cutting surface 64 in a direction of travel indicated by the arrow 66. In this manner, like combination cutter 36 of FIG. 4, negative rake cutting surface 62 displaces a portion of the plastic formation material 18 and directs the displaced formation material 18 in a direction generally toward positive rake cutting surface 64.

Figure 7A:
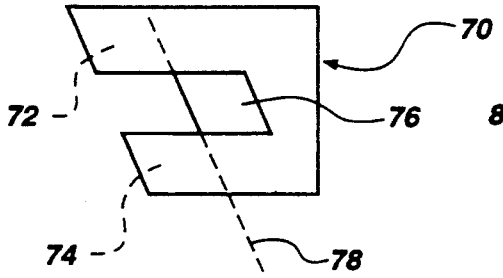
FIGS. 7A–C depict an alternative embodiment on a combination cutter in accordance with the present invention. The cutter is depicted in FIG. 7A from a bottom plan view.
Figure 7B:
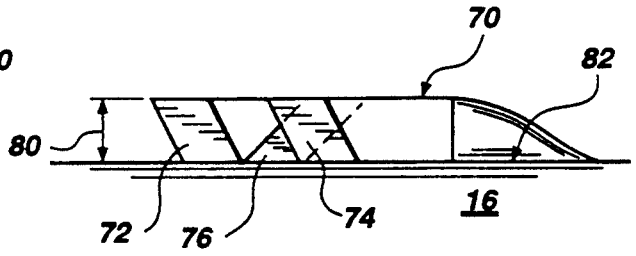

Referring now to FIGS. 7-9, depicted therein is another exemplary embodiment of a cooperative cutter arrangement in accordance with the present invention. FIG. 7A depicts a combination cutter 70 which includes three proximately located and cooperatively associated cutting surfaces: two positive rake cutting surfaces 72, 74, disposed on opposing sides of a negative rake cutting surface 76. In this embodiment, each of the cutting faces 72, 74, 76 also include an identical side rake, along axis 78). As with previous embodiments, each cutting surface 72, 74, 76 is preferably formed of a hardened material such as diamond or tungsten carbide. As can be seen in FIGS. 7B and C, each cutter face extends the same distance 80 from the surface 82 of bit body 16. Combination cutter arrangement 70 may be secured to a bit body in various manners, such as by being brazed on as a separate unit; formed in the metal matrix of a bit body; or by being attached by means of studs secured within the matrix or steel core of a bit body.

Figure 7C:
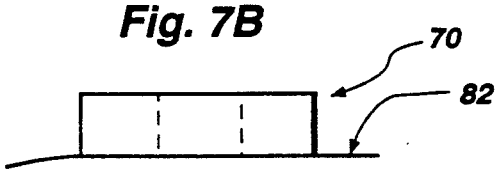
Figure 8A:
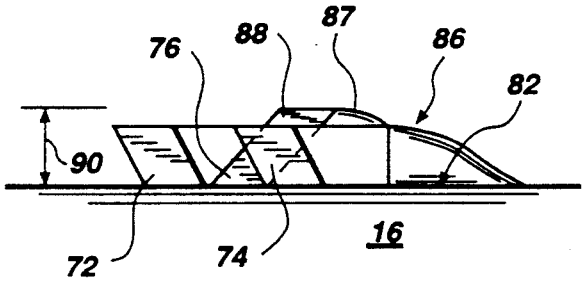
FIGS. 8A–B depict a combination cutter which is similar to the cutter of FIG. 7; depicted in FIG. 8A, from a side view; and in FIG. 8B, from a rear view.
Figure 8B:
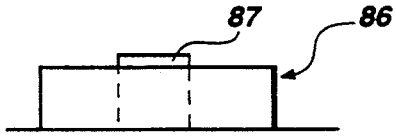

FIGS. 8A-B depict a combination cutter 86 which is a variation of combination cutter 70 of FIGS. 7A-C and similar elements are numbered identically. Combination cutter 86 differs from combination cutter 70 in that a central portion 87 including negatively raked cutting face 88 extends a greater distance 90 from the surface 82 of the bit body than do adjacent positively raked cutting faces 72 and 74.

Figure 9A:
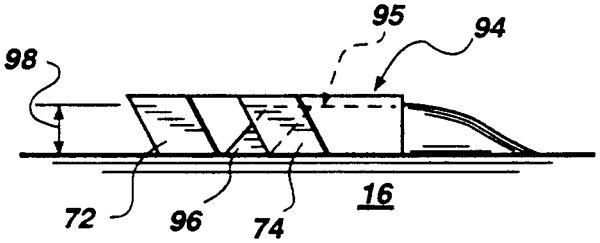
FIGS. 9A–B depict a combination cutter which is similar to the combination cutter of FIG. 7, depicted in FIG. 9A, from a side view; and in FIG. 9B, from a rear view.
Figure 9B:
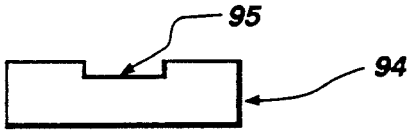

Similarly, FIGS. 9A–B depict a combination cutter 94 which is also a variation of combination cutter 70 of FIG. 8 wherein the central portion 95 including negative rake cutting face 96 extends a lesser distance 98 from surface 82 of the bit body than do cutting faces 72 and 74.

Figure 10A:
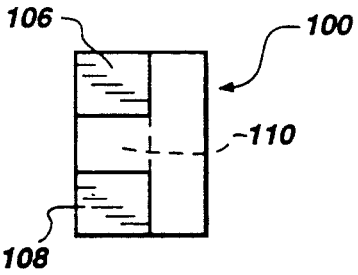
FIGS. 10A–B depict another alternative embodiment of a combination cutter in accordance with the present invention.
Figure 10B:
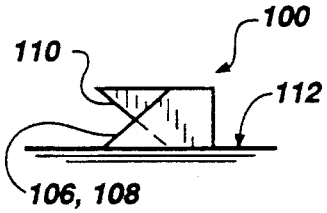

Referring now to FIGS. 10–12, and first to FIGS. 10A–B, therein is depicted another alternative embodiment of combination cutter 100 constructed similarly to combination cutter 70 of FIG. 7. Combination cutter 100 includes two negatively raked cutting surfaces 106, 108 disposed on either side of a positively rake cutting surface 110. In combination cutter 100, each of the cutting surfaces 106, 108, 110 extends a generally uniform distance from surface 112 of the bit body.

Figure 11A:
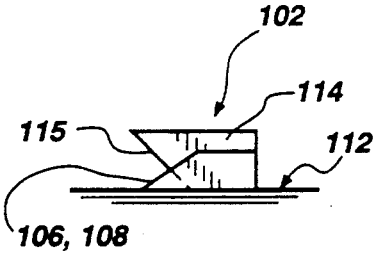
FIGS. 11A–B depict a combination cutter which is similar to the cutter of FIG. 10, depicted in FIG. 11A from a side view and in FIG. 11B from a rear view.
Figure 12A:
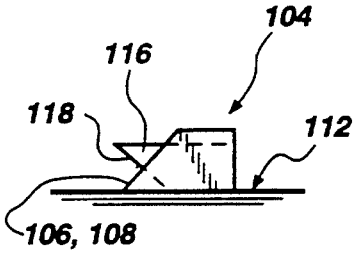
FIGS. 12A–B depict a combination cutter which is similar to the combination cutter of FIG. 10, depicted from a side view.
Figure 11B:
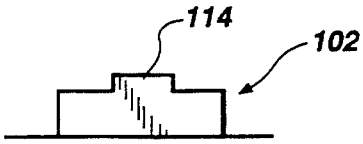
Figure 12B:
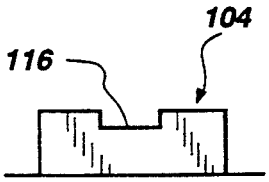

FIGS. 11A–B depict an alternative embodiment of a cutter 102 which differs from cutter 100 in that a central portion 114, including positively raked cutting surface 115, extends a greater distance from surface 112 of the bit body than do flanking portions carrying cutting surfaces 106 and 108. Conversely, FIGS. 12A–B depict a cutter 104 wherein central portion 116 carrying positively raked cutting face 118 extends a lesser distance from surface 112 of the bit body than do the outer flanking portions of cutter 102 carrying negatively raked cutting surfaces 106 and 108.

In the embodiments of FIGS. 10–12, the cutting faces do not include any side rake, but extend relatively along an axis 120 which is perpendicular to the direction of travel of the cutter 122. As will be readily appreciated by those skilled in the art, however, the combination cutters 100, 102, and 104 of FIGS. 10–12 could include a side rake.

Figure 13A:
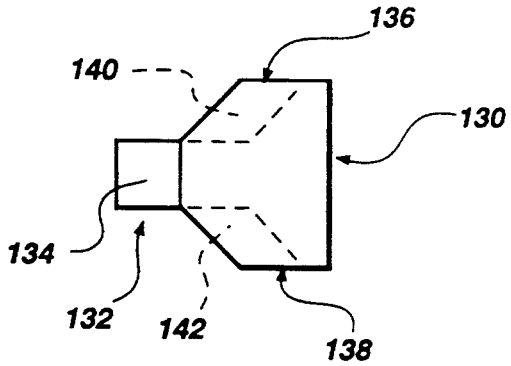
FIGS. 13A–B depicts a further embodiment of a combination cutter in accordance with the present invention. An exemplary combination cutter is depicted in FIG. 13A from a bottom plan view, and in FIG. 13B from a side view.
Figure 13B:
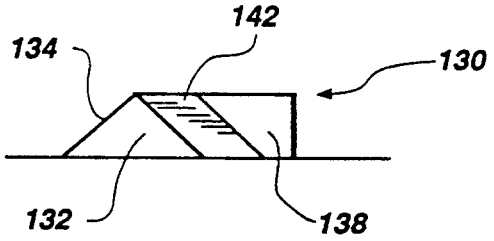
Figure 14:
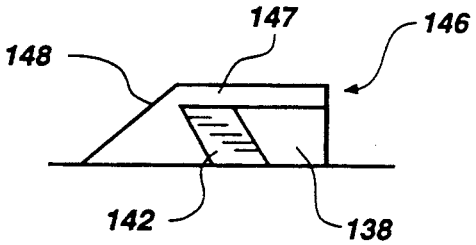
FIG. 14 depicts an embodiment of a combination cutter similar to that of FIG. 13 from a side view.
Figure 15:
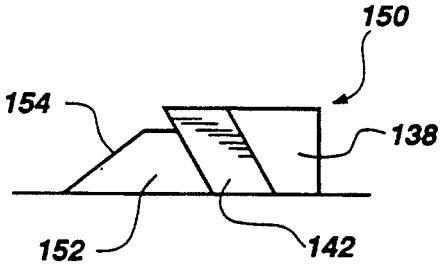
FIG. 15 depicts an, embodiment of a combination cutter similar to that of FIG. 13 from a side view.

Referring now to FIGS. 13–15, therein are depicted further alternative embodiments of combination cutters in accordance with the present invention. Referring first to FIGS. 13A–B, combination cutter 130 includes a central portion 132 carrying a leading negatively raked cutting face 134, and two flanking portions indicated generally at 136 and 138, each of which carry positively raked cutting surfaces 140 and 142, respectively. Cutting face 140 and 142 are each side raked in opposing directions, outwardly from central negatively raked cutting face 134.

Combination outter 146 depicted in FIG. 14, includes a similar construction, except that central portion 147 including negatively raked cutting face 148 extends a greater distance from the bit body thereby flanking portions 136 and 138 carrying positive rake cutting faces 140 and 142, respectively. Conversely, combination cutter 150, as depicted in FIG. 15, includes a central portion 152 carrying negatively rake cutting surface 154 which extends a lesser distance from the surface of the bit body than do flanking portions 136 and 138 including positively raked cutting faces 140 and 142.

As to each of cutters 130, 146, and 150 of FIGS. 13–15, although positively rake cutting faces 140 and 142 are depicted as having similar side rakes in opposing directions, all of the cutting surfaces (both positive and negative) may include differing, or non-complimentary, side rakes. Further, as to each of the embodiments of FIGS. 7–15, as well as other embodiments depicted herein, the cutter combinations need not be formed in individual units or assemblies, but may be composed of individual cutters arranged on a bit to function cooperatively. For example, radially adjacent but discrete positive and negative (or neutral) rake cutters may be secured to the bit face, or the negative or neutral rake cutters may be placed in staggered but substantially overlapping relationship to the positive rake cutters. The primary concept underlying the combinations of varyingly raked cutters according to the present invention is that of cooperation between the differing rake cutting elements. In fact, groups of positive rake cutters may cooperate with groups of negatively-raked cutters. Thus, cutter cooperation may be on a "micro" level, with individual positive and negative cutter cooperation, or on a "macro" level, wherein groups of positive cutters cooperate with groups of negative or neutral rake cutters.

Figure 16:
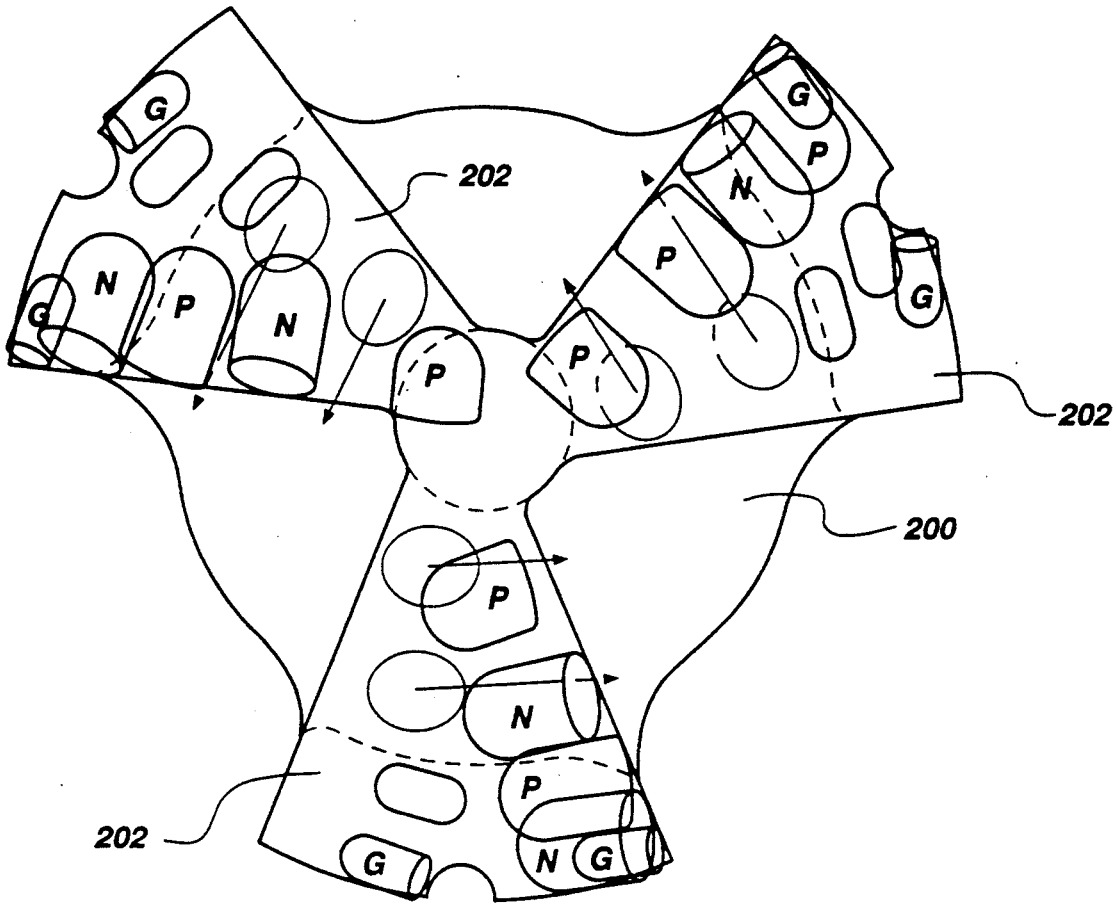
FIGS. 16, 16A and 16B depict, respectively, a bottom plan view of a bladed drill bit having cutters according to the present invention disposed thereon, a side sectional elevation of a blade thereof at a location of a positive rake cutter, and a side sectional elevation of a blade thereof at a location of a negative rake cutter.

FIG. 16 depicts a bottom view (looking upward from the formation) of a 10 ⅝" diameter rotary drill bit 200 of the general type disclosed and claimed in U.S. Pat. No. 4,883,132, assigned to the assignee of the present invention and incorporated herein by this reference. The prior art bit has, however, been modified in accordance with the present invention to include both positive and negative rake cutters on the blades 202 thereof, such cutters being designated by the letters "P" and "N," respectively. Bit 200 includes seven positively raked, disc-shaped PDC cutters, at 10° positive rake with respect to the longitudinal axis (looking perpendicularly into FIG. 16) of bit 200 (see FIG. 16A), and five negatively raked, disc-shaped PDC cutters, at (20° negative rake with regard to the bit axis (see FIG. 16B). Other conventional, negative rake gage cutters G are also depicted in FIG. 16, but do not form a part of the present invention.

Figure 16A:
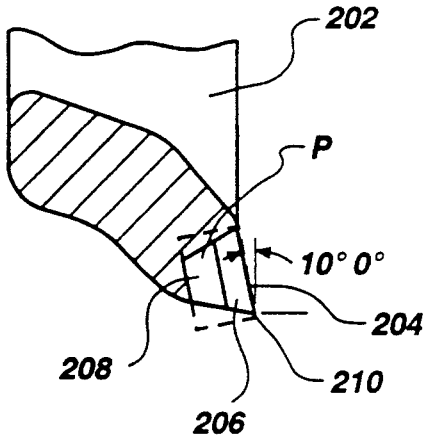

It should be noted with respect to FIG. 16A that the positively raked cutter assemblies P are in the form of truncated cones, or of frustoconical shape, including the edge of diamond table 204, in supporting tungsten carbide substrate or backing 206, and tungsten carbide carrier element 208 furnaced into blade 202. The frustoconical shape of the cutter assembly provides access by cutting edge 210 of diamond table 204 to formation 18, whereas a normal cylindrical or disc-shaped cutter assembly (as shown in broken lines) would in a positively raked orientation, ride on the formation 18 via backing 206 or carrier element 208, blocking contact of cutting edge 208 with the formation 18. It is contemplated that at least part of the periphery of diamond table 204 may be chamfered or radiused, as known in the art, to enhance the durability and fracture resistance thereof. Of course, if half-round cutters would be employed, cutter assemblies P would comprise longitudinally-sectional truncated cones. If square or tombstone-shaped cutters were to be employed in positively-valued cutter assemblies P, an appropriately tapered shape would be employed to provide access by the cutting edges to the formation.

Figure 16B:
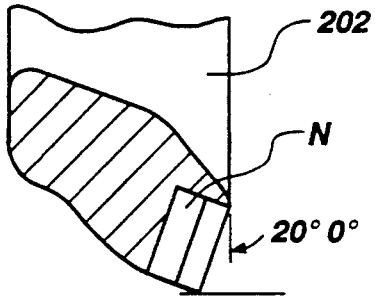

FIG. 16B depicts a cross-section of a portion of a blade 202 carrying a negative take cutter N of conventional cylindrical configuration.

It should be noted that the bit 200 depicted by FIG. 16 provides for full cutter coverage by positive rake cutters P. Stated another way, the rotational paths of the seven positive rake cutters P are substantially adjacent to ensure that substantially the entire formation 18 at the bottom of the borehole is engaged by the more aggressive positive rake cutters P to avoid the situation where the bit would be riding on a ring of formation material cut only by the less aggressive, negative rake cutters N.

While the rake angles of the cutters P and N have been described in FIG. 16 with respect to the bit axis, and not as effective rake angles, it should be noted that, given the bit diameter, a rotational speed of approximately 80–120 revolutions per minute, and a maximum design rate of penetration of fifty feet per hour, all of the positively-raked cutters P will have an effective positive rake, while negatively-raked cutters N will possess effective negative rakes.

Figure 17A:
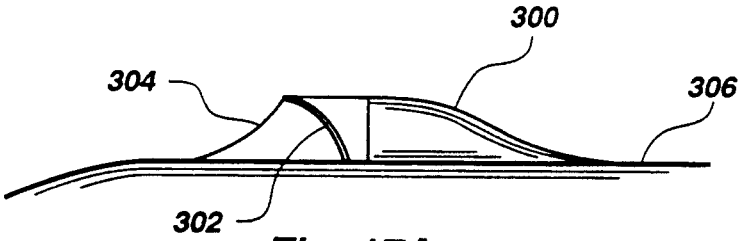
FIGS. 17A, 17B and 17C depict, respectively, front, side and bottom elevations of an alternative embodiment of a combination cutter employing curved cutting surfaces in accordance with the present invention.
Figure 17B:
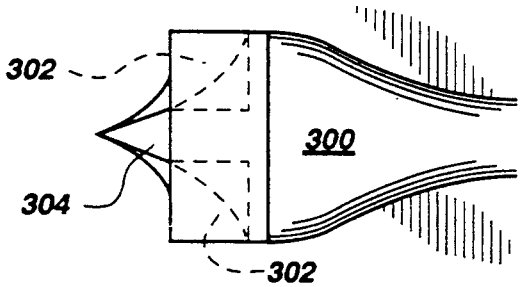
Figure 17C:
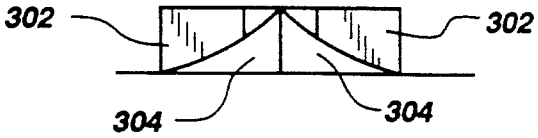

Referring to FIGS. 17A, 17B and 17C of the drawings, yet another embodiment 300 of the invention is depicted. Embodiment 300 includes positive rake concave cutter 302 in combination with negative rake concave cutter 304. While shown to extend substantially the same height above bit face 306, the cutter heights may differ as noted with respect to previous embodiments of the invention. Moreover, as shown in FIG. 17B, a view looking onto the bit face, negative rake cutter 304 may comprise a triangular or "plow" type cutter to direct the formation toward a positive rake cutter 302 on one or both sides of negative rake cutter 304. It is contemplated that such curved cutters may be formed of an array of PDC's or thermally stable PDC's, such as the MOSAIC TM type cutters manufactured by Eastman Christensen Company of Houston, Tex., and disclosed and claimed in U.S. Pat. No. 5,028,177. Alternatively, curved diamond cutters may ideally be formed of a diamond film, applied by chemical vapor deposition (CVD) techniques known in the art. It is also contemplated that a cutter (positive or negative rake) having a curved (concave) cutting surface may be combined with one having a substantially planar one.

Many modifications and variations may be made in the techniques and structures described and illustrated herein without departing from the spirit and scope of the present invention. Accordingly, it should be readily understood that the embodiments described and illustrated herein are illustrative only and are not intended as limitations upon the scope of the present invention.

What is claimed is:

1. A drill bit for rotationally drilling a borehole in a subterranean formation comprising:

a bit body having a face for contacting said formation disposed on its exterior surface;

a first plurality of cutters distributed on said face of said bit, each of said first plurality of cutters having a cutting surface established at an effective negative rake angle relative to the direction of rotation of said bit;

a second plurality of cutters distributed on said face of said bit, each of said second plurality of cutters having a cutting surface established at an effective positive rake angle relative to the direction of rotation of said bit; and each of said first plurality of cutters being cooperatively paired adjacent at least one of said second plurality of cutters.

2. The drill bit of claim 1, wherein said first and second cutting surfaces are generally the same size.

3. The drill bit of claim 2, wherein said first and second cutting surfaces are generally the same width.

4. The drill bit of claim 1, wherein said first and second cutters lie along generally parallel axes.

5. The bit of claim 1, wherein the cutting surfaces of each of said first and second pluralities of cutters define a plane and wherein each of the planar cutting surfaces of said first plurality of cutters intersects the corresponding planar cutting surfaces of the paired second plurality of cutters.

6. A drill bit, as set forth in claim 5, wherein said intersection of said planar cutting surfaces occurs, at least partially, along each of the cutting surfaces of the first plurality of cutters.

7. A drill bit, as set forth in claim 1, wherein the cutting surfaces of each pair of first and second cutters are adjacent one another.

8. A drill bit adapted for rotatably cutting a borehole in a formation at a preselected linear rate, comprising:

a bit body having a face on its exterior surface;

a first plurality of cutters distributed on the face of said bit whereby each of said first plurality of cutters follows a preselected helical path into said formation during the cutting of said formation borehole, said first plurality of cutters each having a cutting surface formed thereon positioned at an angle of greater than 90°, relative to said preselected helical cutting path; and a second plurality of cutters distributed on the face of said bit whereby each of said second plurality of cutters follows a preselected helical path into said formation during the cutting of said formation borehole, said second plurality of cutters each having a cutting surface formed thereon positioned at an angle of less than 90° relative to said preselected helical cutting path; and each of said second plurality of cutters being cooperatively paired with at least one of said first plurality of cutters and comprising means for limiting the cutting depth of said first plurality of cutters.

9. A drill bit, as set forth in claim 8 wherein the cutting surfaces of each of said first and second plurality of cutters each defines a plane, and wherein each of the planar cutting surfaces of said first plurality of cutters intersects the planes of said cutting surfaces of said second plurality of cutters.

10. A drill bit, as set forth in claim 9, wherein the cutting surfaces of each pair of first and second cutters are adjacent one another.

11. A drill bit, as set forth in claim 9, wherein in a pair of first and second cutting surfaces, a first cutting surface is angularly arranged relative to a second cutting surface.

12. A rotary drill bit, comprising:

a bit body;

a plurality of cutters disposed on said bit body, each of said cutters including a cutting surface, at least some of said plurality of cutters arranged in cooperating arrangements wherein portions of said formation affected as said bit rotates by a first, leading, cutting surface in said cooperating arrangement encounter a second, adjacent, trailing, cutting surface; and wherein said first cutting surface is established at a differing effective rake angle from said second cutting surface, relative to the direction of bit rotation.

13. The drill bit of claim 12, wherein said first cutting surface is established at an effective negative rake, and wherein said second cutting surface is established at an effective positive rake.

14. The drill bit of claim 12, wherein said first cutting surface is established at an effective positive rake, and wherein said second cutting surface is established at an effective negative rake.

15. A rotary drill bit including at least one cutter adapted for cutting earth formations, comprising:

a bit body having a bit face disposed on its exterior surface; and said at least one cutter mounted to said bit face and including a longitudinally tapered substrate having a longitudinal axis, a larger end, a smaller end and a substantially planar surface on said larger end substantially transverse to said axis, said larger end carrying a diamond table oriented at an effective positive rake angle relative to the direction of bit rotation.

16. The rotary drill bit of claim 15, wherein said diamond table defines a depth on said substantially planar surface, and the periphery of said depth is contiguous with said longitudinally tapered substrate and aligned with the periphery thereof.

17. The rotary drill bit of claim 15, wherein said diamond table defines a depth on said substantially planar surface and at least part of the periphery of said diamond table depth is chamfered adjacent to said substrate periphery.

18. The rotary drill bit of claim 15, wherein said diamond table defines a depth on said substantially planar surface, and at least part of said periphery of said diamond table depth is radiused adjacent to said substrate periphery.

19. A rotary drill bit comprising:

a bit body having a face disposed on its exterior surface;

a first plurality of cutting surfaces distributed on said face of said bit, each of said first plurality of cutting surfaces established at an effective negative rake angle relative to the direction of bit rotation;

a second plurality of cutting surfaces distributed on said face of said bit, each of said second plurality of cutting surfaces established at an effective positive rake angle relative to the direction of bit rotation; and each of said first plurality of cutting surfaces being cooperatively paired proximate at least one of said second plurality of cutting surfaces.

20. A drill bit adapted for rotatably cutting a borehole in a formation at a preselected linear rate, comprising:

a bit body having a face on its exterior surface;

a first plurality of cutting surfaces distributed on the face of said bit whereby each of said first plurality of cutting surfaces follows a preselected helical path into said formation during the cutting of said formation borehole, each of said first plurality of cutting surfaces being positioned at an angle of greater than 90°, relative to said preselected helical cutting path;

a second plurality of cutting surfaces distributed on the face of said bit whereby each of said second plurality of cutting surfaces follows a preselected helical path into said formation during the cutting of said formation borehole, each of said second plurality of cutting surfaces being positioned at an angle of less than 90° relative to said preselected helical cutting path; and each of said second plurality of cutting surfaces being cooperatively paired with proximate at least one of said first plurality of cutting surfaces and comprising means for limiting the cutting depth of said first plurality of cutting surfaces.

* * * * *